US008209911B2

(12) United States Patent
Welch et al.

(10) Patent No.: US 8,209,911 B2
(45) Date of Patent: Jul. 3, 2012

(54) HYDROSTATICALLY ENABLED STRUCTURE ELEMENT (HESE)

(75) Inventors: Charles R. Welch, Vicksburg, MS (US); Kevin Abraham, Vicksburg, MS (US); Robert M. Ebeling, Vicksburg, MS (US); Karen Buehler, Northbridge, MA (US); Claudia Quigley, Lexington, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 47 days.

(21) Appl. No.: 12/793,790

(22) Filed: Jun. 4, 2010

(65) Prior Publication Data

US 2011/0047886 A1 Mar. 3, 2011

Related U.S. Application Data

(60) Provisional application No. 61/237,358, filed on Aug. 27, 2009.

(51) Int. Cl.
*E04C 3/36* (2006.01)
*E04G 21/00* (2006.01)

(52) U.S. Cl. ..... 52/2.21; 52/745.17

(58) Field of Classification Search ..... 52/2.21, 52/2.17, 742.13, 745.17, 2.22; 248/560, 248/562, 636; 405/288, 289, 290, 291
See application file for complete search history.

(56) References Cited

U.S. PATENT DOCUMENTS

| | | | | |
|---|---|---|---|---|
| 3,998,918 | A | 12/1976 | Grawey et al. | |
| 4,560,145 | A | 12/1985 | Widmer | |
| 4,983,077 | A * | 1/1991 | Sorge et al. | 405/288 |
| 5,143,340 | A * | 9/1992 | Wood et al. | 248/354.2 |
| 5,493,816 | A * | 2/1996 | Willemsen | 52/2.11 |
| 6,015,005 | A | 1/2000 | Durchenwald | |
| 6,092,788 | A | 7/2000 | Simon | |
| 6,394,707 | B1 * | 5/2002 | Kennedy et al. | 405/288 |
| 6,463,699 | B1 | 10/2002 | Bailey et al. | |
| 6,524,670 | B1 | 2/2003 | Kataoka | |
| 6,575,251 | B2 | 6/2003 | Watson et al. | |
| 7,137,432 | B2 | 11/2006 | Senic et al. | |
| 7,232,103 | B2 * | 6/2007 | Heath | 248/631 |
| 7,293,412 | B2 * | 11/2007 | Fuchs | 60/512 |
| 7,335,109 | B2 * | 2/2008 | Chen | 472/134 |
| 7,735,265 | B2 * | 6/2010 | Tinker et al. | 52/2.16 |
| 8,070,394 | B2 * | 12/2011 | Skarbovig | 405/289 |
| 2010/0135732 | A1 * | 6/2010 | Skarbovig | 405/289 |
| 2010/0247249 | A1 * | 9/2010 | Skarbovig | 405/289 |
| 2011/0222970 | A1 * | 9/2011 | Skarbovig | 405/289 |

* cited by examiner

*Primary Examiner* — Basil Katcheves
*Assistant Examiner* — Rodney Mintz
(74) *Attorney, Agent, or Firm* — Earl H. Baugher, Jr.

(57) ABSTRACT

A structural element employing hydrostatic pressure to compress cohesion-less particles to significantly increase the load carrying capacity of the element along a load-bearing axis, a system for deploying said structural element and a method for deploying said structural element using the system.

22 Claims, 7 Drawing Sheets

HYDROSTATICALLY ENABLED STRUCTURE ELEMENT (HESE)

RELATED APPLICATIONS

Under 35 U.S.C. §119(e)(1), this application claims the benefit of prior co-pending U.S. Provisional Patent Application Ser. No. 61/237,358, Hydrostatically Enabled Structure Element (HESE), by Welch et al., filed Aug. 27, 2009, and incorporated herein by reference.

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Phillip Stewart at 601 634-4113.

BACKGROUND

Structure elements comprising "inflatables" are known in the art. See, for example, the AirBeams™of Vertigo, Inc. at www.vertigo-inc.com. One such element is an arch that is made of a woven fabric exterior and an internal membrane that is pressurized with air. The arch further comprises "cohesionless" particles that are compressed against the fabric exterior by air pressure inflating the internal membrane. This "hydrostatically enabled" arch, when stabilized by suitable guy wires, is able to support an SUV hanging from its center, much more than otherwise possible without the addition of the particles. Tension straps on the top and bottom are used for additional reinforcement to support the heavy loads.

This demonstration of the concept has led to plans for further development by the U.S. Army, specifically the Inverse Triaxial Structural Element (ITSE) Project with a goal of developing a practical demonstration of the use of very high performance tensile fabrics. The approach is to develop and test the concept using existing fabrics, using structural test results to calibrate and validate and develop a finite element model (FEM) of structure. A validated FEM model would then be used with a continuum model to predict enhancement of fabric materials, in particular those employing carbon nanotubes (CNT), and structure using the CNT fabric.

In support of the ITSE Project, the Army developed a test structure for testing the basic concept of "hydrostatic enablement." The concept of the test structure is illustrated in FIG. 1. Refer to FIG. 1, showing a top view of a test apparatus 10 with the center section 12 further depicted for illustration purposes only. A test device 10 incorporating a reinforced rigid external cylinder 11 incorporates a center 12 comprising a flexible tube filled with cohesion-less particles 14, such as dry sand, the cylinder 11 filled with water 15. The water 15 is pressurized to a pressure represented as $\sigma_3$ to enable the center column to withstand a load represented as $\sigma_1$. As the value of $\sigma_3$ increases to a pre-specified amount the available loading capacity of $\sigma_1$ also increases to a pre-specified amount as the center column of particles 14 stiffens under the increasing compressive force $\sigma_3$. This is best seen in FIG. 1B in which a first "differential" stress-strain curve 17 depicts the relationship between $\sigma_3$ and $\sigma_1$ for a "nominal value" of $\sigma_3$. As $\sigma_3$ is increased by increasing the water pressure in the cylinder 10, the value of $\sigma_1$ also increases as indicated by the differential stress-strain curve 16 and the dashed curve 18 indicating the significant increase in slope of the differential curve 16 with an increase in $\sigma_3$. This follows the Mohr-Coulomb relation for cohesion-less soils:

$$\tau=(\sigma-\mu)\tan(\phi)+c \tag{1}$$

where:

$\tau$=shear strength (stress)

$\sigma$=normal stress c=cohesion (intercept of failure envelope with $\tau$ axis)

$\phi$=slope of the failure envelope (angle of internal friction)

$\mu$=hydrostatic pressure

The U.S. Army has investigated using thin wall structures for "hydrostatically enabled" structure elements. Refer to FIG. 2. In FIG. 2A, a "support column" 202 of cohesion-less particles 203, such as dry sand, encased in a flexible membrane 204, such as butyl rubber or the like, is compressed and made more rigid by the use of pressure, $\sigma_c'$, equally impressed over its length. FIG. 2B is a top view of the thin-walled tube 202 showing the opposing force, $\sigma_c'$, inside the thin-walled tube, the relationship to tensile force, T, given by:

$$\sigma_c'=Td/2t \tag{2}$$

where:

T=tensile force in a thin-walled cylinder d=diameter of a thin-walled cylinder t=thickness of the thin wall $\sigma_c'$=hydrostatic pressure applied Eqn. (2) may be used to design appropriately sized systems based on the basic theory of the Mohr-Coulomb relation of Eqn. (1) and pre-specified loads, $\sigma$, expected. For example, a designer can specify the thickness, t, and diameter, d, of a thin-wall tube based on how much hydrostatic pressure will need to be applied to support a pre-specified axial load, $\sigma$.

An alternative depiction of the effect of "stiffening" of cohesion-less particles is shown in FIG. 2C, a stress-strain curve, indicating how a low applied hydrostatic pressure, $\sigma_{cL}'$, exhibits a significantly lower load, $\sigma_1'$, than a higher applied hydrostatic pressure, $\sigma_{cH}'$, at the same slope of the failure envelope, $\phi'$.

Refer to FIG. 3A, a test configuration 301 for the ITSE. The filled tube 301 comprises an outer membrane 302 of abrasion resistant material, such as woven Kevlar® or the like, an inner bladder 304 of flexible material, such as urethane, butyl rubber or the like, and a "fill" of cohesion-less particles 305, such as dry sand of medium density. A suitable fluid 303, such as air, is employed to inflate the inner bladder 304 and provide the necessary pressure to stiffen the particles 305 into a rigid mass impressed against both the bladder 304 and the outer membrane 302. FIG. 3B is a loading layout of the configuration 301 of FIG. 3A, the configuration 301 emplaced upon supports 306, prior to impressing a load, $\sigma_2$. Testing demonstrated the viability of the ITSE concept. The filled tubes for the test were about 10.2 cm (four inches) in diameter and about 61 cm (two feet) in length. They had a compliant internal urethane bladder and an external membrane of polyester bias braid, the same material as the air arch that supported an SUV. The internal bladder was inflated to 100 psi, providing axial loading to full mobilization of the shear strength of the particulates, dry sand, or of either membrane. A 3-point bending test was conducted to full mobilization of the shear strength of the soil or of either the internal bladder or external membrane.

Test results are shown in the graphs of FIGS. 4 and 5. FIG. 4 shows results for two test units in compression, showing less than about 3.8 cm (1.5 in.) extension for a load in excess of 4,000 lbs and less than about 4.4 cm (1.75 in.) extension for a load of about 5,400 lbs, making the unit able to carry a load about 12 times greater than a tube filled only with dry sand. FIG. 5 shows a linear deflection curve of flexural force (psi) vs. deflection (in.), topping near 1000 psi at a deflection of only about 5.1 cm (two inches).

U.S. Pat. No. 6,463,699, Air Beam Construction Using Differential Pressure Chambers, to Bailey, describes a closed tubular cylindrical shell of air impermeable fabric having fixed within the shell an "I-beam envelope" comprising flexible, air impermeable walls sealed to the interior of the shell. The I-beam envelope extends the length of the shell and defines air chambers in communication with an inflation valve. Compressible material is dispersed throughout the interior of the I-beam envelope. When subjected to compressive forces by pressurization of the air chambers the material becomes rigid, thus able to support increased loading, albeit horizontal in the normal orientation of I-beams. The filled envelope is either vented to atmosphere or connected to a vacuum source.

The above demonstrates the feasibility of hydrostatically enabled structure elements but does not address many of the practical considerations for use of the technology. One such consideration is use of these structure elements in addressing damages to existing structure to mitigate further catastrophic deterioration, injury or loss of life. Select embodiments of the present invention address this and other practical applications.

DETAILED DESCRIPTION

Figure 1A:
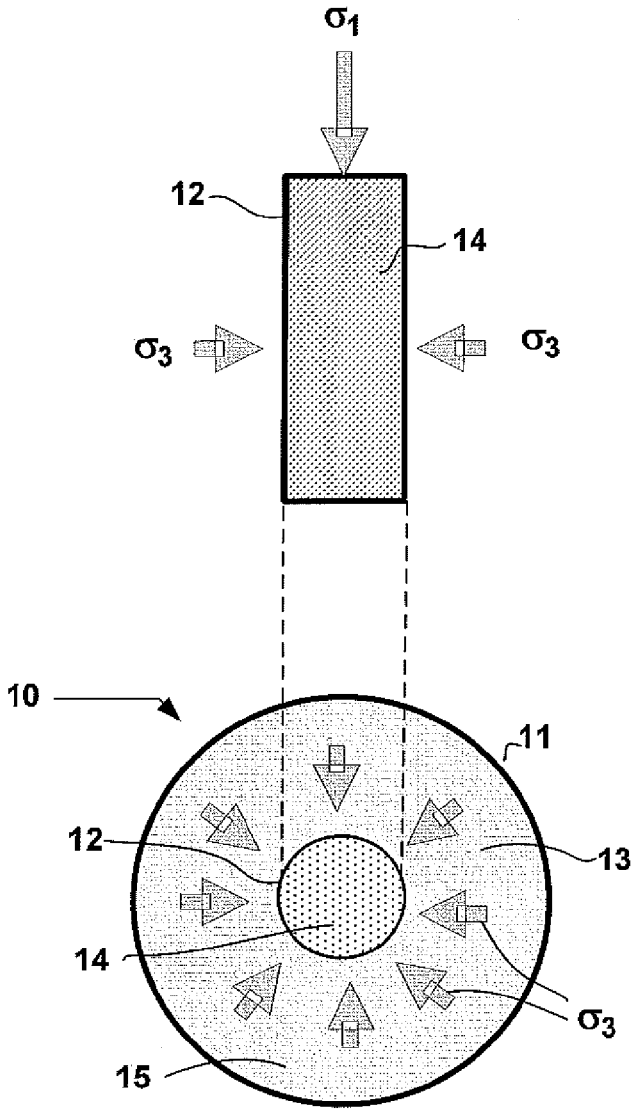
Fig. 1A Prior Art
FIG. 1A (Prior Art) explains the theory of operation of select embodiments of the present invention.
Figure 1B:
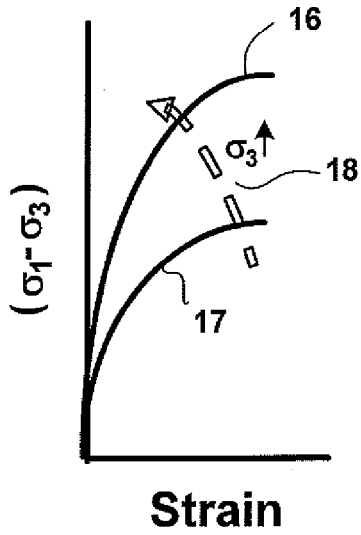
Fig. 1B Prior Art
FIG. 1B (Prior Art) is a graph displaying the increase in load-carrying capacity that may be expected for select embodiments of the present invention when hydrostatic pressure is increased.
Figure 2A:
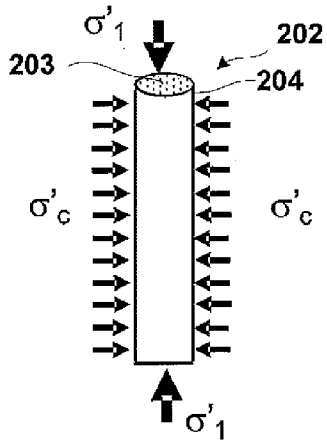
Fig. 2A Prior Art
FIG. 2A (Prior Art) is an alternative way of depicting a part of FIG. 1A.
Figure 2B:
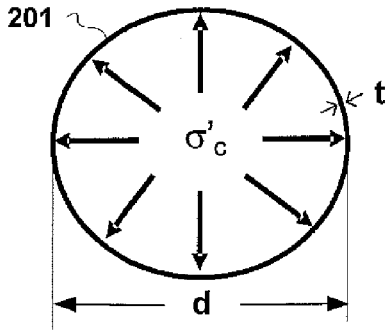
Fig. 2B Prior Art
FIG. 2B (Prior Art) is an alternative way of depicting a second part of FIG. 1A.
Figure 2C:
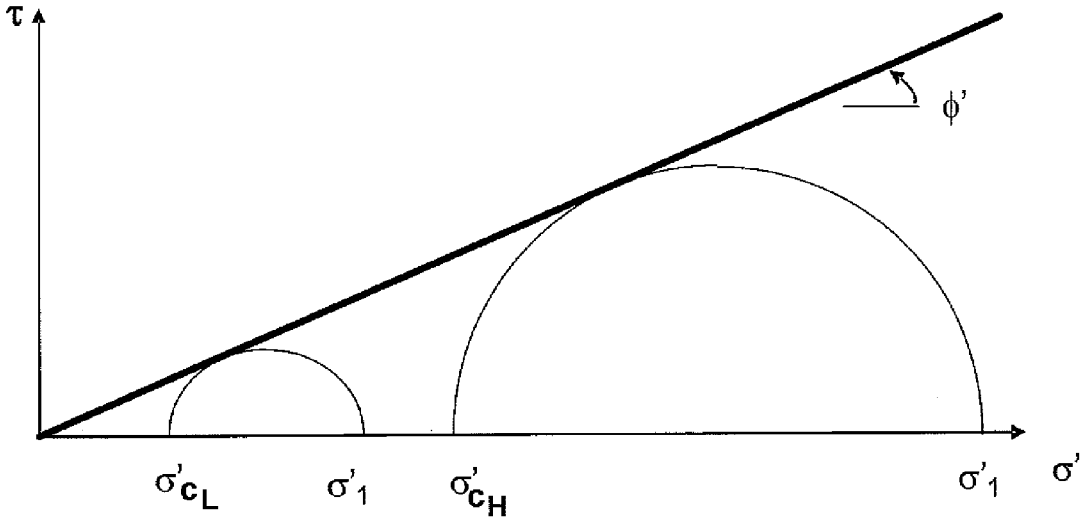
Fig. 2C Prior Art
FIG. 2C (Prior Art) is an alternative way of showing the advantages of increasing hydrostatic pressure that may be expected when used in select embodiments of the present invention.
Figure 3A:
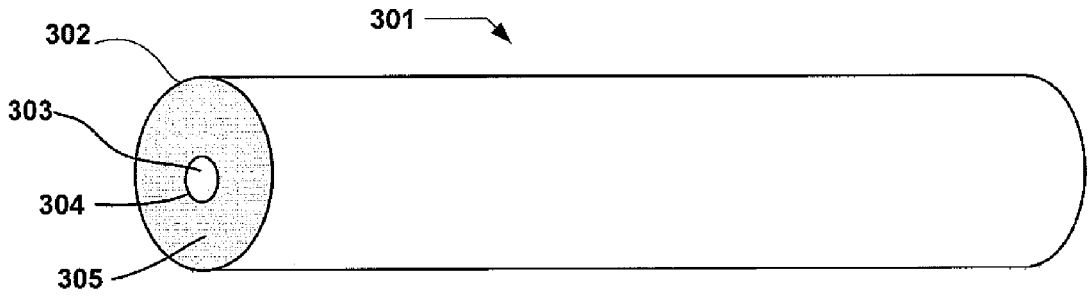
Fig. 3A Prior Art
FIG. 3A (Prior Art) depicts an embodiment as may be employed horizontally in the present invention.
Figure 3B:
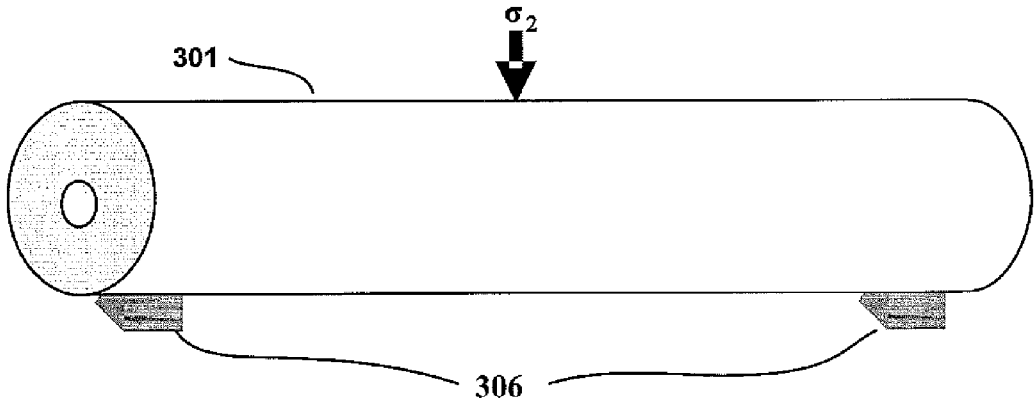
Fig. 3B Prior Art
FIG. 3B (Prior Art) shows a test setup for the embodiment of FIG. 3A.
Figure 4:
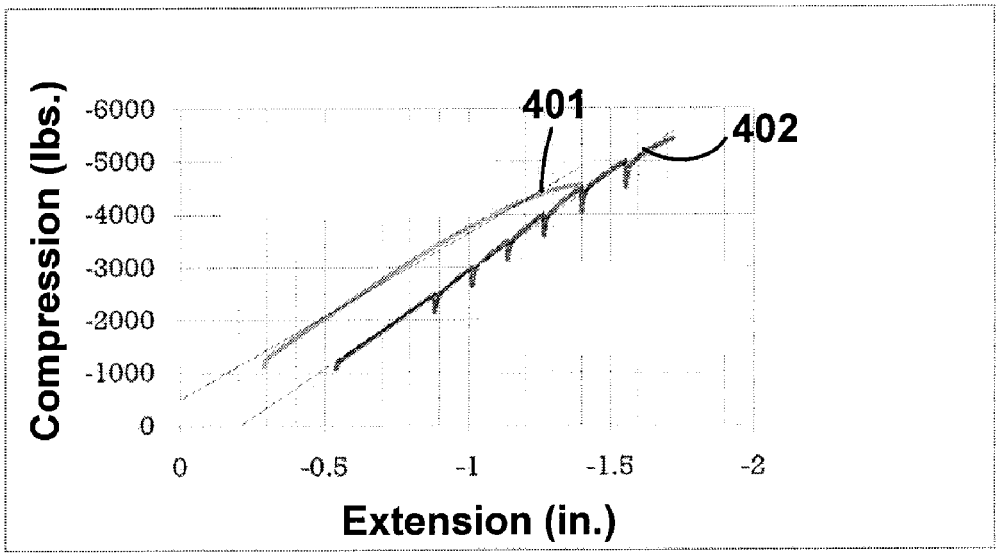
Fig. 4 Prior Art
FIG. 4 (Prior Art) is a graph depicting compression vs. extension as test results from a first test of units that may be employed in select embodiments of the present invention.
Figure 5:
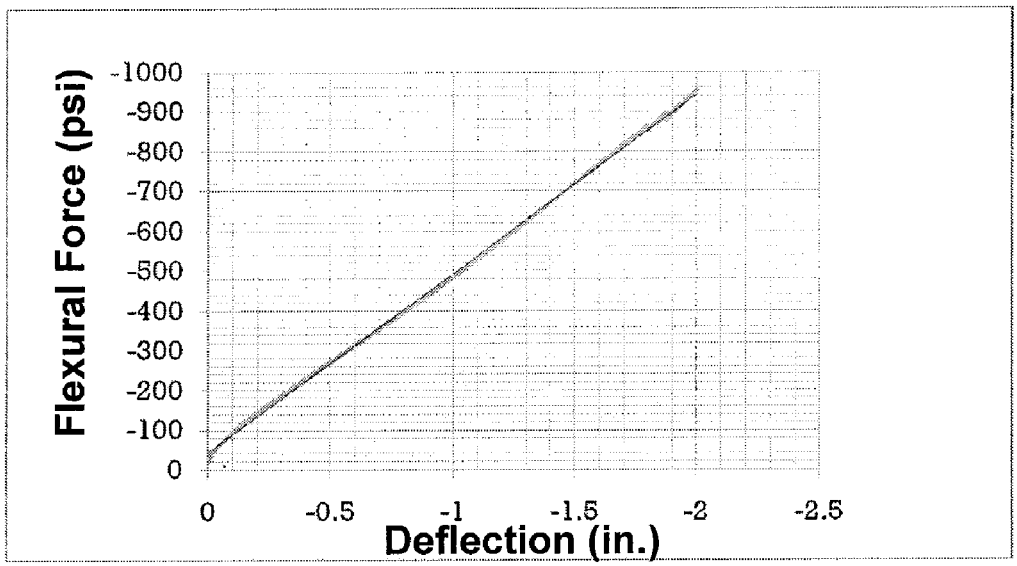
Fig. 5 Prior Art
FIG. 5 (Prior Art) is a graph depicting flexural force vs. deflection test results from a second test of units that may be employed in select embodiments of the present invention.

Select embodiments of the present invention provide a transportable, readily deployed system for providing temporary support to damaged structure, for assuring safe access to partially collapsed structure, and for stabilizing existing structure in anticipation of catastrophic failure.

Upon deployment, select embodiments of the present invention comprise one or more pressurized compartments, these pressurized compartments immediately adjacent one or more sections containing cohesion-less particles that upon pressurizing the compartments become a rigid mass capable of supporting loads significantly greater than when the compartments are not pressurized.

Select embodiments of the present invention envision a structural element comprising: one or more first components comprising a top; a bottom; one or more elastic tubes of a first type sealed to the top and bottom; and one or more valves affixed to a tube of a first type to permit pressurization thereof; an elastic tube of a second type sealed to the top and bottom and incorporating one or more openings for filling the tube, the tube being co-extensive with, and adjacent to, the one or more tubes of a first type, the tube of a second type establishing one or more chambers of a first type between the one or more first components and the elastic tube of a second type while also establishing a chamber of a second type, the external dimensions of which chamber of a second type are defined by the internal perimeter of a tube of a second type and the top and bottom; one or more ports for access both near the top and near the bottom of the tube of a second type; and cohesion-less particles, such that upon pressurizing the at least one chamber of a first type and filling the chamber of a second type with the cohesion-less particles, the structural element becomes a rigid mass capable of supporting loads significantly greater than when the one or more chambers of a first type are not pressurized.

In select embodiments of the present invention the one or more chambers of a first type further comprise first and second chambers of a first type, the first chamber of a first type external to the chamber of a second type and the second chamber of a first type centered within the chamber of a second type, concentric and co-extensive with the long axis of the chamber of a second type, the boundary of the second chamber of a first type defined by a third elastic tube sealed to the top and bottom.

In select embodiments of the present invention the first and second chambers of a first type are in fluid communication with each other.

In select embodiments of the present invention the cohesion-less particles comprise man-made material. In select embodiments of the present invention the cohesion-less particles comprise dry sand.

In select embodiments of the present invention the top comprises a cylinder of height much less than its diameter, the cylinder incorporating passages for transferring the cohesion-less particles. In select embodiments of the present invention the cylindrical top is rigid.

In select embodiments of the present invention the bottom comprises a cylinder of height much less than its diameter, the cylinder incorporating passages for transferring the cohesion-less particles. In select embodiments of the present invention the bottom cylinder is rigid.

Select embodiments of the present invention envision a system facilitating rapid deployment of a structural element comprising: one or more first components comprising a top; a bottom; one or more elastic tubes of a first type sealed to the top and bottom; and one or more valves affixed to each tube of a first type to permit pressurization thereof; an elastic tube of a second type sealed to the top and bottom and incorporating one or more openings for filling, the tube of a second type co-extensive with, and adjacent to, the one or more tubes of a first type, the tube of a second type establishing one or more chambers of a first type between the one or more first components and the tube of a second type and establishing a chamber of a second type, the external dimensions of which chamber of a second type are defined by the internal perimeter of the tube of a second type and the top and bottom; one or more ports for access to the tube of a second type; cohesion-less particles; one or more sources for pressurizing the one or more tubes of a first type; and one or more sources for providing the cohesion-less particles to the chamber of a second type, such that upon pressurizing the one or more chambers of a first type and filling the chamber of a second type with the cohesion-less particles, the structural element becomes a rigid mass capable of supporting loads significantly greater than when the one or more chambers of a first type are not pressurized.

In select embodiments of the present invention the one or more sources for providing the cohesion-less particles further comprise: a vessel; a conduit from the vessel; and a pump affixed to the conduit, such that the conduit originates near the bottom of the vessel and terminates near the top of the chamber of a second type when filling the chamber of a second type and the conduit originates near the top of the vessel and terminates near the bottom of the chamber of a second type when emptying the chamber of a second type.

In select embodiments of the present invention the system's source for pressurizing comprises one or more air compressors.

In select embodiments of the present invention the system's one or more chambers of a first type further comprise first and second chambers of a first type, the first chamber of a first type external to the chamber of a second type and the second chamber of a first type centered within the chamber of a second type, concentric and co-extensive with the long axis of the chamber of a second type, the boundary of the second chamber of a first type defined by a third elastic tube sealed to the top and bottom.

In select embodiments of the present invention the system's first and second chambers of a first type are in fluid communication with each other.

In select embodiments of the present invention the system's cohesion-less particles comprise man-made material.

In select embodiments of the present invention the system's cohesion-less particles comprise dry sand.

In select embodiments of the present invention the system's top comprises a cylinder of height much less than diameter, the cylinder incorporating passages for transferring the cohesion-less particles. In select embodiments of the present invention in the system's cylindrical top is rigid.

In select embodiments of the present invention the system's bottom comprises a cylinder of height much less than diameter, the cylinder incorporating passages for transferring the cohesion-less particles. In select embodiments of the present invention the system's cylindrical bottom is rigid.

Select embodiments of the present invention envision a method for rapidly deploying a structural support comprising: providing a structural element incorporating one or more first components comprising a top; a bottom; one or more elastic tubes of a first type sealed to the top and bottom; and one or more valves incorporated in the tube of a first type to permit pressurization thereof; an elastic tube of a second type sealed to the top and bottom and incorporating one or more openings for filling the tube of a second type, the tube co-extensive with, and adjacent to, the one or more tubes of a first type, the tube of a second type establishing one or more chambers of a first type between the one first component and the tube of a second type and establishing a chamber of a second type, the external dimensions of which chamber of a second type are defined by the internal perimeter of the tube of a second type and the top and bottom; one or more ports for access to the tube of a second type; cohesion-less particles; one or more sources for pressurizing the one or more tubes of a first type; and one or more sources for providing the cohesion-less particles to the chamber of a second type; positioning the structural element where support to a structure is required; providing a compressor; providing a source of cohesion-less particles; providing a transfer mechanism for transferring the cohesion-less particles; pressurizing the one or more chambers of a first type to extend the structural element to contact the structure requiring support; and transferring the cohesion-less particles to the chamber of a second type, such that the structural element becomes a rigid mass capable of supporting the structure at the point of contact with the structure.

In select embodiments of the present invention the method further comprises reversing the method to transfer the cohesion-less particles back to the source and to deflate the tubes of a first type upon not requiring the employment of the structural element for support of the structure.

Figure 6A:
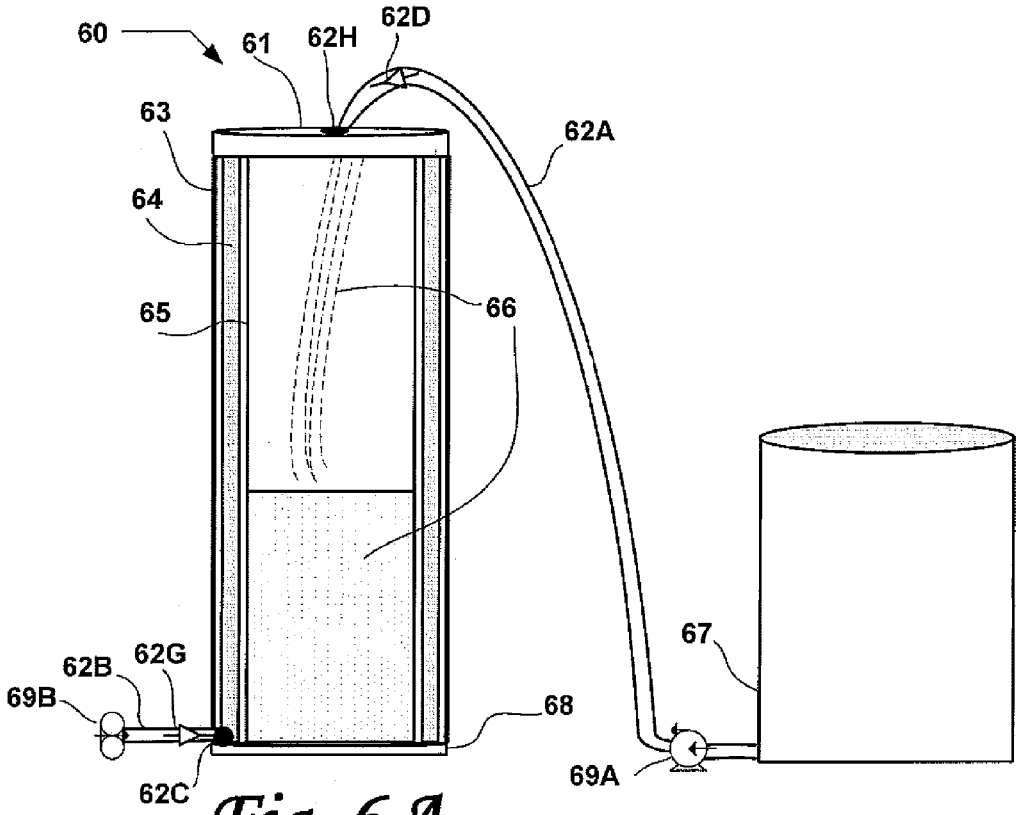
FIG. 6A illustrates select embodiments of the present invention as deployed.

Refer to FIG. 6A. Select embodiments of the present invention comprise a system 60 that comprises a top 61 and bottom 68 support for a contained flexible, compressible structure comprising an outer abrasion resistant "skin" 63 attached to both the top 61 and bottom 68 supports that may include "folds" that "accordion" (FIG. 6B) to allow employment along a longitudinal axis and reduction in size along the same axis for storage and transport. The skin 63 may be deployed by inflating a first internal cylindrical bladder 64 attached to the top 61 and bottom 68 supports and adjacent the inside surface of the skin 63. The first internal cylindrical bladder 64 is suitable for providing a tensile force via fluid pressure that inflates the bladder 64 against both the skin 63 and a second internal bladder 65, the second bladder 65 attached to both the top 61 and bottom 68 supports, the second bladder 65 wholly internal to the first bladder 64. The second internal bladder 65 may be deployed along the longitudinal axis via inflation of the first bladder 64. Upon deployment of the system 60, the first bladder 64 is inflated via a compressor 69B and hose 62B attached to a valve 62G connected to a port 62C at the bottom of the first bladder 64 to extend the system 60 to a pre-specified "working length" along its longitudinal axis. Upon extension of the system 60 to its working length, a pump 69A, such as a centrifugal pump, pumps "cohesion-less" particles 66, e.g., dry sand or manmade particles of pre-specified characteristics such as density, diameter, and the like, from a vessel 67 via a second hose 62A and a second valve 62D into a port 62H at the top of the second bladder 65. Once the second bladder 65 is filled to a pre-specified height, typically the working length of the system 60, the first bladder 64 is pressurized to a pre-specified pressure to establish a pre-specified tension on both the skin 63 and the inner bladder 65. In select embodiments of the present invention, the pre-specified pressure is selected to support an expected load along the longitudinal axis of the system 60. In select embodiments of the present invention the load is applied directly along the longitudinal axis at the top of the system 60 when deployed. Thus, e.g., the system 60 may be deployed between the flooring supports and ceiling joists of a structure to support a ceiling that is anticipated to collapse.

Figure 6B:
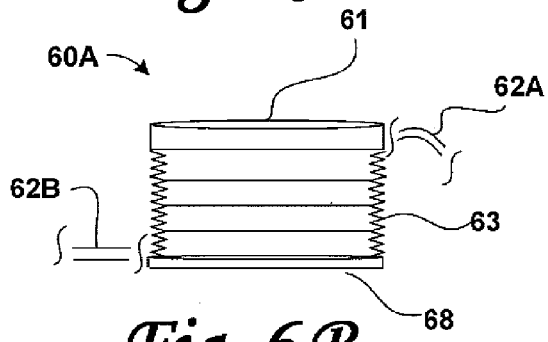
FIG. 6B depicts select embodiments of the present invention as stored or transported.

Refer to FIG. 6B, depicting the part 60A of the system 60 of FIG. 6A that is in its stored or transported configuration. The hoses 62A, 62B are simply disconnected after the cohesion-less particles 66 are evacuated from the bladder 65 by reversing the pump 69A and the pressurizing bladder 64 is evacuated by reversing the compressor 69B, permitting the skin 63 to be "accordioned" down to a suitable size for transport and storage.

Figure 7:
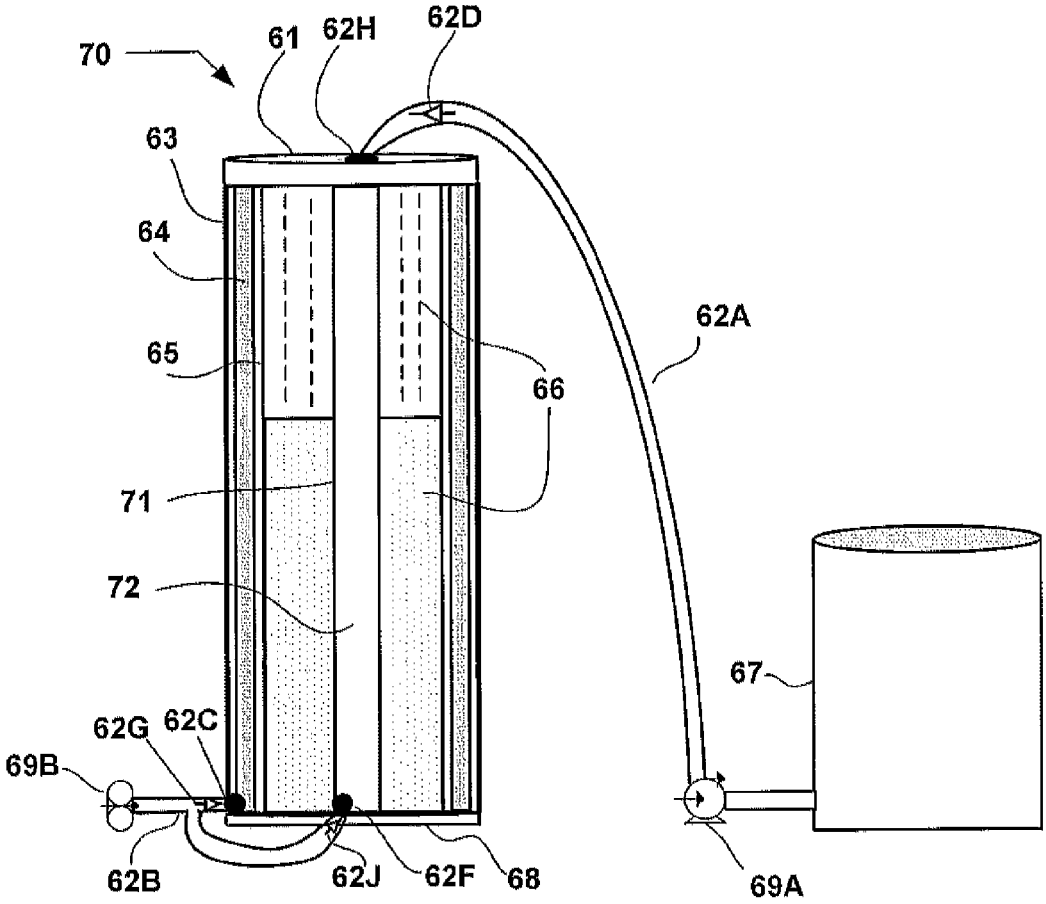
FIG. 7 shows an alternative to FIG. 6A for select embodiments of the present invention.

Refer to FIG. 7 illustrating an alternative system 70 to that of FIG. 6A. The system 70 will fold for shipping in much the same manner as that of the system 60, i.e., it will take approximately the same configuration as that of the storage/transporting configuration 60A. The system 70 contains an extra internal bladder 71 filled from a port 62F at the bottom of the bladder 71 that both reduces the amount of cohesion-less particles 66 required and provides a "back-up" to the first pressurizing bladder 64 should the external skin 63 be punctured together with the pressurizing bladder 64. The extra internal bladder 71 may be filled via the compressor and hose 62B of the system 60, requiring only another valve 62J to insure proper filling and maintenance of pressure. Further, in addition to the advantage of using less particles 66, the extra internal bladder 71 will allow the pressure to be applied to the "hollow column" of particles 66 from two sides of the rigidized column of particles 66, allowing a quicker and possibly more uniform "packing" of the particles 66. This would be particularly advantageous in situations in which the system 70 needs to be deployed quickly. As noted above, the extra protection of the extra internal bladder 71 afforded by the packed particles 66 surrounding it, provides a measure of security not available with having only the first internal bladder 64 of the system 60. Further, the fluid 72 used in the bladder 71 need not be air, but could be an inert fluid, e.g., nitrogen or even water, in rare cases where flammables dictate the need for extra caution when using hoses 62B that may be susceptible to rupture or puncture due to hostile actions.

Figure 8:
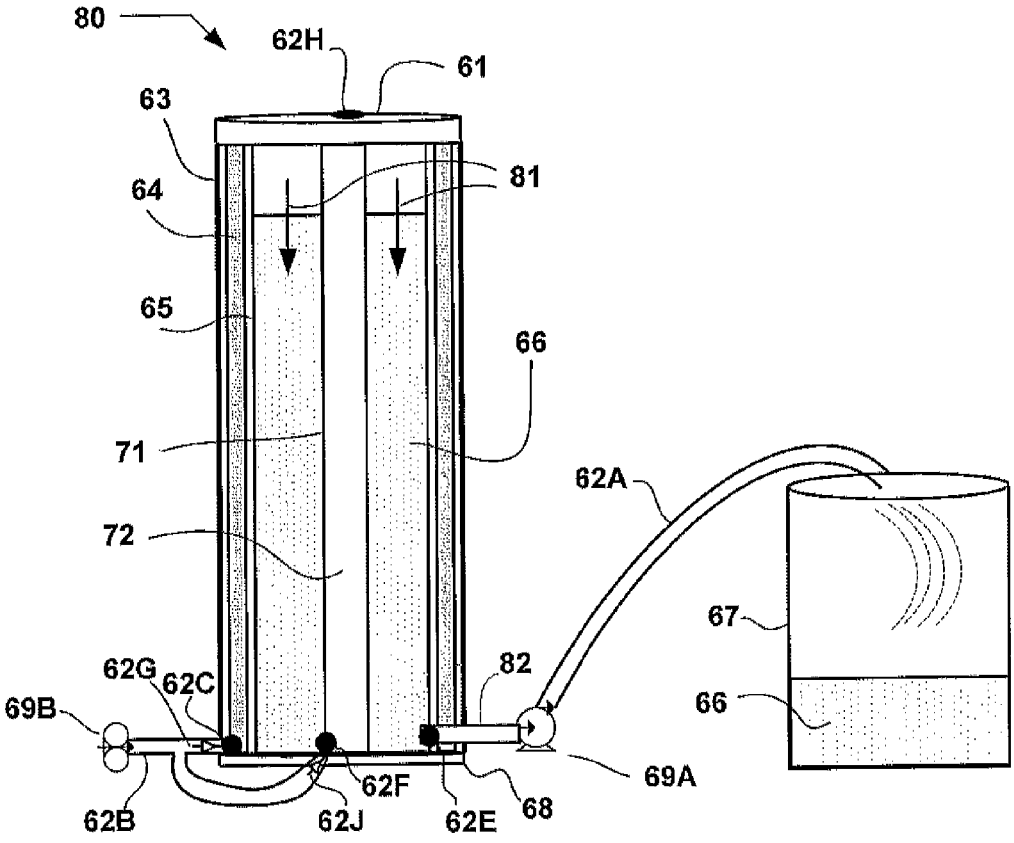
FIG. 8 depicts the reversing of the process depicted in FIG. 7 for select embodiments of the present invention.

Refer to FIG. 8 depicting the reversal of the process shown in FIG. 7. The system 80 for de-pressurizing and transferring the cohesion-less material 66 (as shown by arrows 81) back to a source vessel 67 merely reverses the direction of the pump 69A connected via a passage way 82 to the base of the chamber 65 to allow the material 66 to be pumped through the conduit 62A back to a source vessel 67.

The abstract of the disclosure is provided to comply with the rules requiring an abstract that will allow a searcher to quickly ascertain the subject matter of the technical disclosure of any patent issued from this disclosure. 37 CFR §1.72 (b). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for use in supporting damaged structures, it may be used for any type of portable structure where quick installation is desired. Thus select embodiments of the present invention may be useful in such diverse applications as mining, rescue, temporary construction of housing, outdoor concerts, military deployment, temporary recreational activities, and the like. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A structural element comprising:

at least one first component comprising:

a top;

a bottom;

at least one elastic tube of a first type sealed to said top and said bottom; and at least one valve in operable communication with said tube of a first type to permit pressurization thereof;

an elastic tube of a second type sealed to said top and said bottom and incorporating at least one opening for filling and co-extensive with, and adjacent to, said at least one tube of a first type, said tube of a second type establishing at least one chamber of a first type between said top and said bottom and said elastic tube of a second type and establishing a chamber of a second type, the external dimensions of which chamber of a second type are defined by the internal perimeter of said tube of a second type and said top and said bottom;

at least one port for access near the top of and at least one port for access near the bottom of said tube of a second type; and cohesion-less particles, wherein upon pressurizing said at least one chamber of a first type and filling said chamber of a second type with said cohesion-less particles, said structural element becomes a rigid mass capable of supporting loads significantly greater than when said at least one chamber of a first type is not pressurized.

2. The structural element of claim 1 in which said cohesion-less particles comprise man-made material.

3. The structural element of claim 1 in which said cohesion-less particles comprise dry sand.

4. The structural element of claim 1 said at least one chamber of a first type further comprising first and second chambers of a first type, said first chamber of a first type external to said chamber of a second type and said second chamber of a first type centered within said chamber of a second type, concentric and co-extensive with the long axis of said chamber of a second type, the boundary of said second chamber of a first type defined by a third elastic tube sealed to said top and said bottom.

5. The structural element of claim 4, said first and second chambers of a first type being in fluid communication with each other.

6. The structural element of claim 1 in which said top comprises a cylinder of height much less than its diameter, said cylinder incorporating passages for transferring said cohesion-less particles.

7. The structural element of claim 6, said cylinder being rigid.

8. The structural element of claim 1 in which said bottom comprises a cylinder of height much less than its diameter, said cylinder incorporating passages for transferring said cohesion-less particles.

9. The structural element of claim 8, said cylinder being rigid.

10. A system facilitating rapid deployment of a structural element, comprising:

at least one first component comprising:

a top;

a bottom;

at least one elastic tube of a first type sealed to said top and said bottom; and at least one valve in operable communication with said tube of a first type to permit pressurization thereof;

a elastic tube of a second type sealed to said top and said bottom and incorporating at least one opening for filling and co-extensive with, and adjacent to, said at least one tube of a first type, said tube of a second type establishing at least one chamber of a first type between said top and said bottom and said elastic tube of a second type and establishing a chamber of a second type, the external dimensions of which chamber of a second type are defined by the internal perimeter of said tube of a second type and said top and said bottom;

at least one port for access to said tube of a second type;

cohesion-less particles;

at least one source for pressurizing said at least one elastic tube of a first type; and at least one source for providing said cohesion-less particles to said chamber of a second type, wherein upon pressurizing said at least one chamber of a first type and filling said chamber of a second type with said cohesion-less particles, said structural element becomes a rigid mass capable of supporting loads significantly greater than when said at least one chamber of a first type is not pressurized.

11. The system of claim 10 in which said cohesion-less particles comprise man-made material.

12. The system of claim 10 in which said cohesion-less particles comprise dry sand.

13. The system of claim 10, said source for providing said cohesion-less particles further comprising:

a vessel;

a conduit in operable communication with said vessel; and a pump in operable communication with at least said conduit, wherein said conduit originates near said vessel's bottom and terminates near the top of said chamber of a second type when filling said chamber of a second type and said conduit originates near said vessel's top and terminates near the bottom of said chamber of a second type when emptying said chamber of a second type.

14. The system of claim 10, said source for pressurizing comprising at least one air compressor.

15. The system of claim 10, said at least one chamber of a first type further comprising first and second chambers of a first type, said first chamber of a first type external to said chamber of a second type and said second chamber of a first type centered within said chamber of a second type, concentric and co-extensive with the long axis of said chamber of a second type, the boundary of said second chamber of a first type defined by a third elastic tube sealed to said top and said bottom.

16. The system of claim 15, said first and second chambers of a first type being in fluid communication with each other.

17. The system of claim 10 in which said top comprises a cylinder of height much less than diameter, said cylinder incorporating passages for transferring said cohesion-less particles.

18. The system of claim 17 said cylinder being rigid.

19. The system of claim 10 in which said bottom comprises a cylinder of height much less than diameter, said cylinder incorporating passages for transferring said cohesion-less particles.

20. The system of claim 19 said cylinder being rigid.

21. A method for rapidly deploying a structural support, comprising:

providing a structural element comprising:

at least one first component comprising:

a top;

a bottom;

at least one elastic tube of a first type sealed to said top and said bottom; and at least one valve in operable communication with said tube of a first type to permit pressurization thereof;

a elastic tube of a second type sealed to said top and said bottom and incorporating at least one opening for filling and co-extensive with, and adjacent to, said at least one tube of a first type, said tube of a second type establishing at least one chamber of a first type between said top and said bottom and said elastic tube of a second type and establishing a chamber of a second type, the external dimensions of which chamber of a second type are defined by the internal perimeter of said tube of a second type and said top and said bottom;

at least one port for access to said tube of a second type;

cohesion-less particles;

at least one source for pressurizing said at least one elastic tube of a first type; and at least one source for providing said cohesion-less particles to said chamber of a second type;

positioning said structural element where support to a structure is required;

providing a compressor;

providing a source of cohesion-less particles;

providing a transfer mechanism for transferring said cohesion-less particles;

pressurizing said at least one chamber of a first type to extend said structural element to contact said structure requiring support; and transferring said cohesion-less particles to said chamber of a second type, wherein said structural element becomes a rigid mass capable of supporting said structure at the point of contact with said structure.

22. The method of claim 21 further comprising reversing said method to transfer said cohesion-less particles back to said source and to deflate said tubes of a first type upon not requiring the employment of said structural element for support of said structure.

* * * * *